United States Patent [19]

Poulette et al.

[11] Patent Number: 4,650,149

[45] Date of Patent: Mar. 17, 1987

[54] MOLD ASSEMBLY FOR INSTALLING A GASKET IN THE PERIPHERAL WALL OF AN OPENING IN A WALL

[76] Inventors: Fernand Poulette, 2210, rue Principale, Sainte-Elisabeth, County of Berthier, Canada, J0K 2J0; Jean-Claude Vezina, 3335 Chambois Street, Trois-Rivières, West, Quebec, Canada, G8Y 3M7

[21] Appl. No.: 343,668

[22] Filed: Jan. 27, 1982

Related U.S. Application Data

[63] Continuation of Ser. No. 116,239, Jan. 28, 1980, abandoned.

[51] Int. Cl.[4] ..... E02D 29/10

[52] U.S. Cl. ..... 249/11; 249/39; 249/83; 249/96; 249/145; 249/177; 249/183

[58] Field of Search ..... 249/83, 95, 145, 184, 249/35, 39, 96, 177, 183

[56] References Cited

U.S. PATENT DOCUMENTS

| | | | |
|---|---|---|---|
| 2,234,784 | 3/1941 | Stoltz | 249/35 |
| 2,633,263 | 3/1953 | Stonaker | 249/35 |
| 2,652,168 | 9/1953 | Nelson | 249/35 |
| 2,955,332 | 10/1960 | Hite | 249/83 |
| 3,758,066 | 9/1973 | Skinner | 249/184 |
| 3,815,214 | 6/1974 | Kyle | 249/83 |

FOREIGN PATENT DOCUMENTS

| | | | |
|---|---|---|---|
| 971997 | 7/1975 | Canada | 249/83 |
| 1282903 | 11/1968 | Fed. Rep. of Germany | 249/35 |
| 757553 | 9/1956 | United Kingdom | 249/35 |

*Primary Examiner*—Donald Czaja
*Assistant Examiner*—Jennifer Cabaniss

[57] ABSTRACT

There is disclosed a mold assembly for casting a concrete wall having an opening and for anchoring a flexible resilient ring-like gasket in the peripheral wall of said opening to make a seal with a pipe passing through the opening. The assembly includes a pair of spaced mold walls for receiving unset concrete therebetween, a flexible resilient annular mold arranged to extend between the mold walls with its end surfaces in respective sealing contact with the inner surfaces of the mold walls and a rigid mold-supporting member removably inserted within the annular mold to support the latter while concrete is cast about the annular mold and between the mold walls. The outer surface of the annular mold has a continuous annular groove, intermediate the end surfaces, to receive the pipe-engaging portion of the gasket. Once the concrete is set, the outer anchoring portion of the gasket is embedded in the concrete. The mold-supporting member is axially withdrawn from the annular mold and the latter withdrawn from the opening and from the gasket by inwardly flexing the same.

5 Claims, 6 Drawing Figures

MOLD ASSEMBLY FOR INSTALLING A GASKET IN THE PERIPHERAL WALL OF AN OPENING IN A WALL

The instant application is a continuation of application Ser. No. 116,239, filed 1-28-1980 and now abandoned.

FIELD OF THE INVENTION

This invention relates to a mold assembly for casting a concrete wall having an opening and for anchoring a flexible resilient ring-like gasket in the peripheral wall of the opening to make a seal with a pipe passing through the opening.

BACKGROUND OF THE INVENTION

It is often desired to prevent inflow or outflow of liquid around a pipe passing through an opening in a masonry wall. This is particularly important in the installation of manholes for sanitary sewers, since one desires to keep the interior of a manhole reasonably dry. It is known to install sealing elements, or gaskets, around pipes extending through manholes. On example of such gasket is shown in U.S. Pat. No. 3,832,438, issued Aug. 27, 1974, and consists generally of a peak portion which engages the pipe and a leg portion which is embedded in concrete around the peripheral wall of the opening. In the above Patent, the peak portion of the gasket is positioned in a groove formed between the mating edges of two oppositely tapered metal molds. The molds are mounted between the walls of a form and concrete is poured between the walls to embed the leg portion of the gasket in said peripheral wall of the opening when the concrete is set. The above-disclosed apparatus for installing the gasket is expensive since it requires precision machining of the metal molds and differently shaped molds to suit manholes walls of various thicknesses and curvatures.

OBJECT OF THE INVENTION

It is therefore the object of the present invention to provide a mold assembly of the character described, which obviates the above-noted disadvantages.

SUMMARY OF THE INVENTION

The mold assembly of the assembly comprises a pair of spaced mold walls for receiving unset concrete therebetween, a flexible resilient annular mold having opposite end surfaces, an outer surface and an inner surface, said annular mold extending between said mold walls and having a length such that its end surfaces are in respective sealing contact with the inner surfaces of said mold walls, said outer surface having a continuous groove intermediate said end surfaces to receive the pipe-engaging portion of the gasket, and a rigid mold-supporting member removably inserted within the annular mold and having an outer surface which is in contact with the inner surface of the annular mold to support the latter while concrete is cast about the annular mold and between said mold walls. There are further provided means for removably securing the mold-supporting member to at least one of the mold walls.

Once the concrete is cured and the form walls removed, the mold-supporting member can be axially withdrawn from the annular mold and the latter withdrawn from the opening and from the gasket by inwardly flexing the annular mold.

When the form walls are curved, for instance when it is desired to mold a cylindrical manhole, the mold-supporting member has a flange extending outwardly from one end for fitting into a groove at the corresponding end of the flexible, resilient annular mold, whereby the latter is flexed by the flange to conform to the curved mold walls and the mold-supporting member is secured to one of the curved mold walls.

The mold-supporting member must not be any longer than the flexible annular mold, so that the ends of the latter may make good sealing contact with the mold walls. Since the annular mold is flexible, it can be used with mold walls of various curvatures within a predetermined range.

The invention will now be disclosed, by way of example, with reference to the accompanying drawings, in which.

Figure 4:
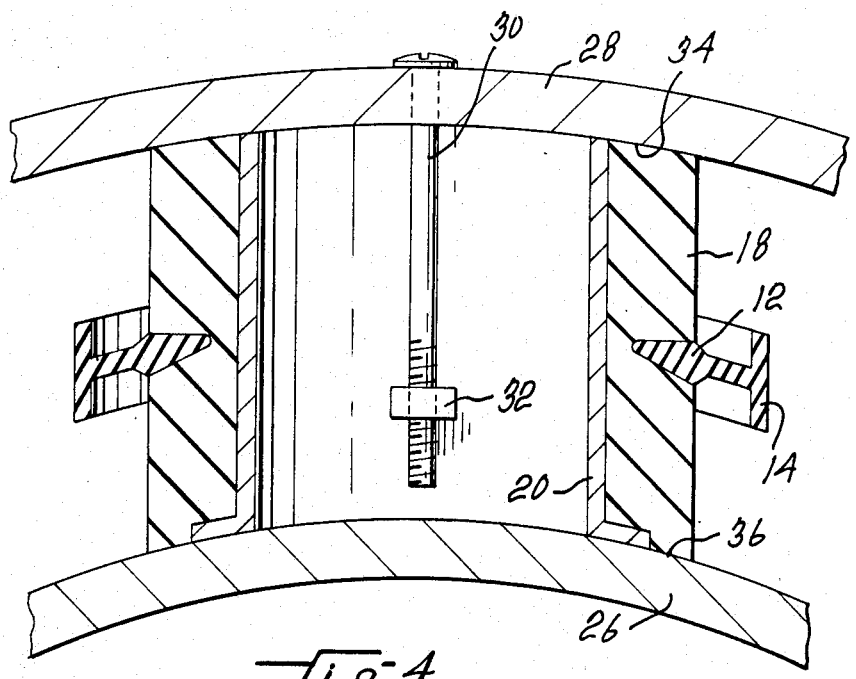
FIG. 4 illustrates the assembly of FIG. 3 after having been installed between the walls of the form.

Referring to FIGS. 1–4 of the drawings, there is shown a gasket 10, having a pipe-engaging portion 12 and a T-shaped anchoring portion 14. The pipe-engaging poriton of the gasket is positioned and fitted in a groove 16 in the outside periphery of a cylindrical flexible, resilient mold 18, which is preferably made of rubber or similar elastomeric material. A cylindrical mold-supporting member 20, preferably made of metal and having the same outside diameter as the inside diameter of mold 18, is inserted inside the mold for supporting such mold. The cylindrical member 20 has a flange 22 at one end which is adapted to fit into 24 an undercut recess made in the end of resilient mold 18 adjacent the inner surface of the latter. As shown in FIG. 4, the thickness of flange 22 is not greater than the depth of recess 24.

Figure 1:
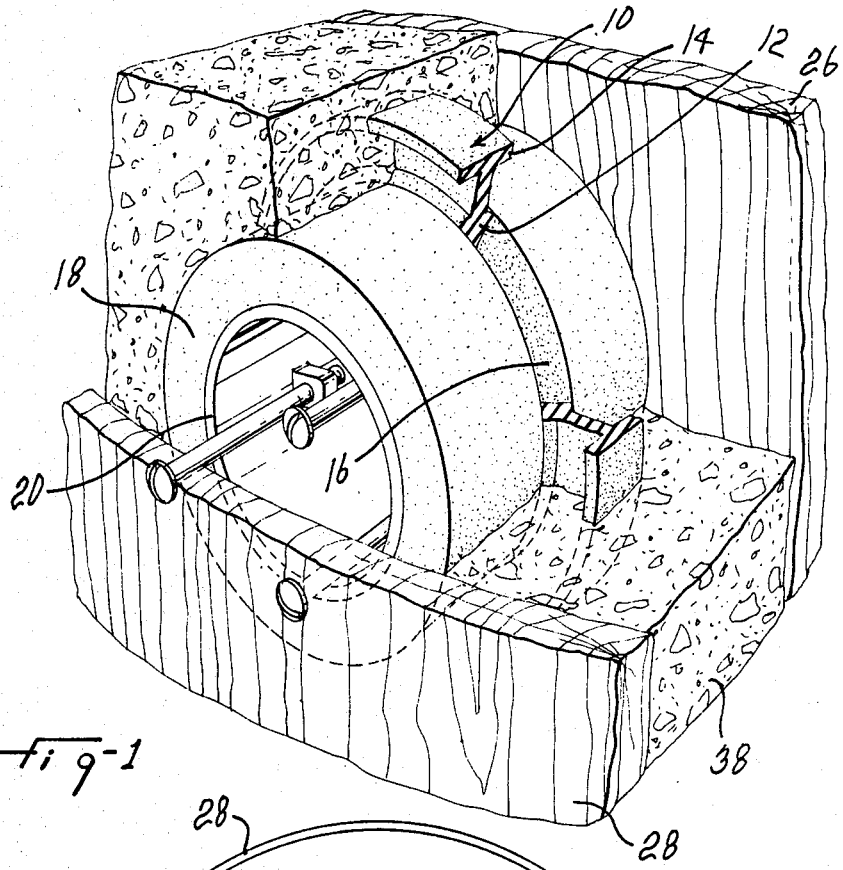
FIG. 1 illustrates a perspective view of an apparatus, in accordance with the invention, embedded in concrete prior to being removed to leave the opening in the concrete with the gasket secured in place.
Figure 2:
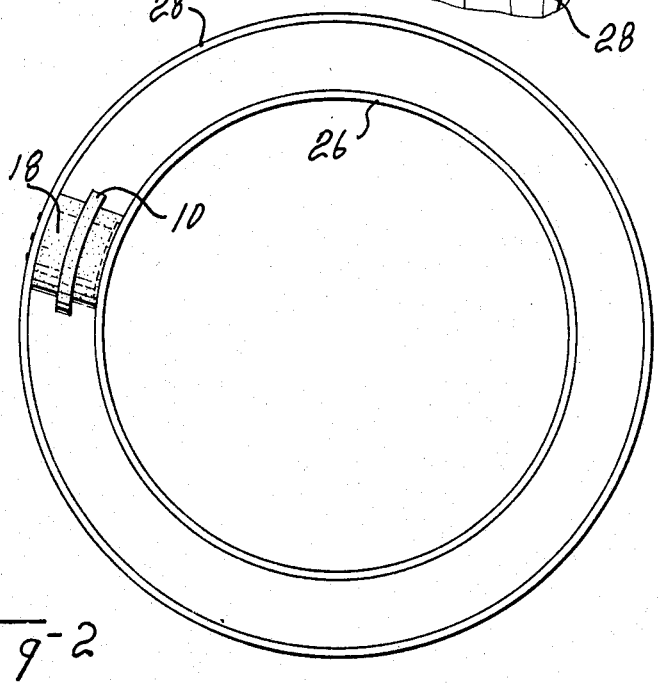
FIG. 2 illustrates a top view of a concrete form wherein the apparatus in accordance with the invention is installed prior to pouring the concrete.
Figure 3:
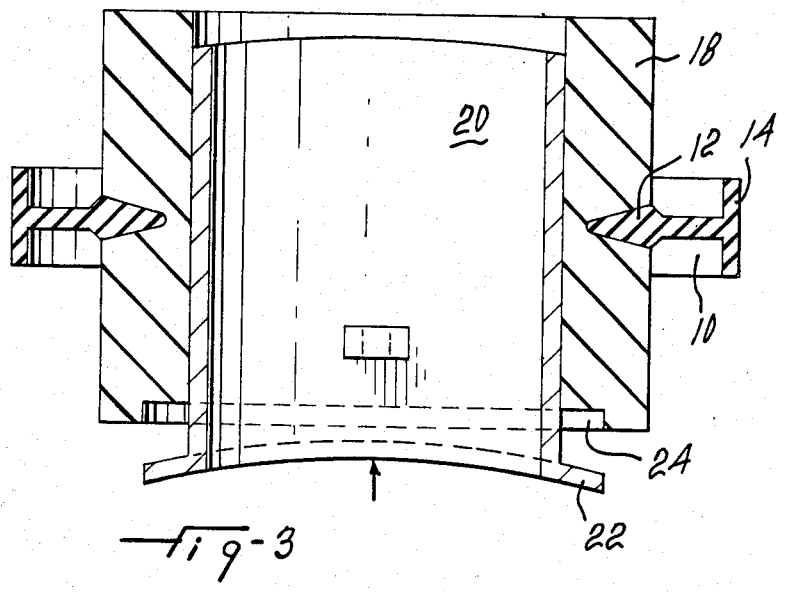
FIG. 3 illustrates a plan section view through the mold and its supporting member before its installation between the walls of a form.

The resulting assembly is installed between the inside wall 26 and the outside wall 28 of a form for pouring concrete, as shown in FIG. 2 of the drawings. As illustrated in FIG. 4 of the drawings, the cylindrical member 20 is secured to the outside wall 28 by means of bolts 30, which are threaded into threaded elements 32, welded or otherwise secured to the inside periphery of the cylindrical member 20.

It will be noted that the flange 22 and the other end of the mold-supporting member 20 are shaped to conform to the contour of the curved walls 26 and 28. During tightening of the bolts 30, member 20 is pulled towards wall 28 and the flexible, resilient mold 18 is deformed to conform to the contour of the wall 28 and, thus, forms a tight seal at the end 34 of the mold. The other wall 26 of the framework is then installed to complete the assembly. During installation, wall 26 is pushed into good contact with the end 36 of the mold to also form a tight seal therewith. Of course, the cylindrical member 20 could be secured to the inside wall of the framework and the outside wall installed thereafter, if it is more suitable.

Concrete 38 is then poured to fill the space between walls 26 and 28 and also embed the anchoring portion 14 of the gasket 10.

Figure 5:
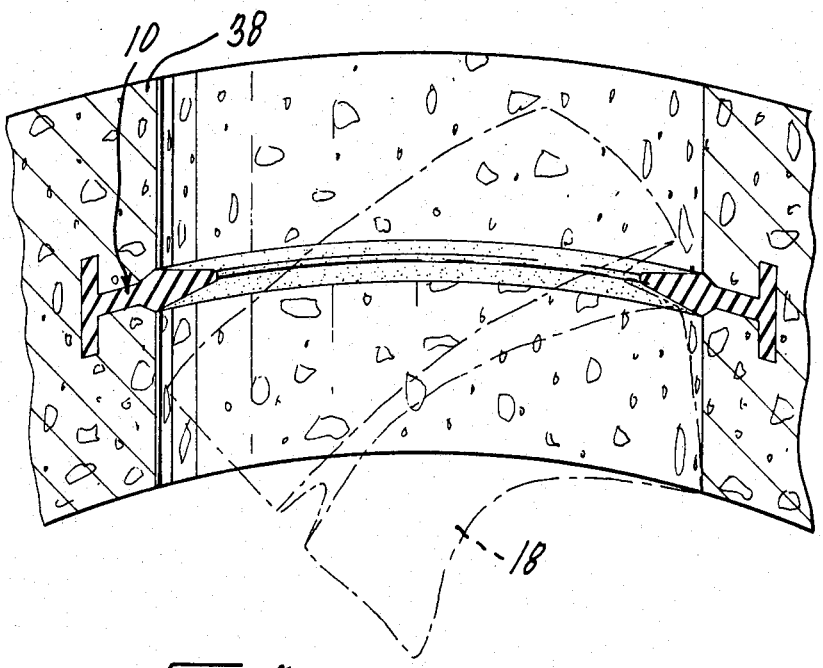
FIG. 5 and 6 illustrate in plan section and in elevation, respectively, the removal of the mold supporting the gasket after the concrete has set.
Figure 6:
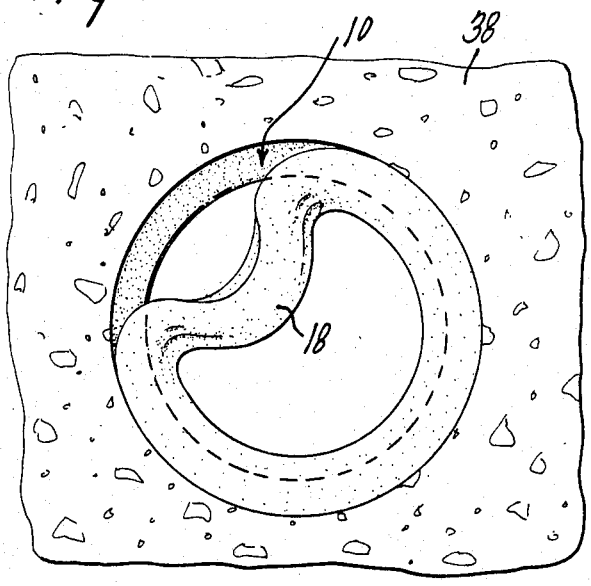

When the concrete has set, bolts 30 are unscrewed to release the mold-supporting member 20 and both walls of the framework can then be removed. The mold-supporting member is then axially removed from within flexible, resilient mold 18 and, finally, mold 18 is disengaged by hand or by means of a suitable tool from the pipe-engaging portion of the gasket, by inwardly flexing the same as shown in FIGS. 5 and 6 of the drawings, so as to leave the pipe-engaging portion of the gasket projecting into the space intended to receive the pipe.

It will be seen that the above apparatus permits easy installation of a gasket in the peripheral wall of an opening. As the mold is resilient, it may be easily compressed to form a good seal for pouring concrete without any danger of developing a leak around the mold in the opening. As the mold is flexible, it conforms to the curvature of form walls of various diameters as used in making manholes. The flexible mold can also be easily removed from its supporting member after such a supporting member has been withdrawn.

Although the invention has been disclosed with reference to a preferred embodiment, it is to be understood that it is not limited to such embodiment and that other alternatives are also envisaged. For example, other means of securing the mold-supporting member to the framework can be used. Furthermore, for thicker walls, two or more flaxible molds could utilized side by side with one of the molds carrying the gasket.

What we claim is:

1. A mold assembly for casting a concrete wall having an opening and for anchoring a flexible resilient ring-like gasket in the peripheral wall of said opening to make a seal with a pipe passing through ssid opening, said gasket having an inner pipe-engaging portion and an outer anchoring portion, said assembly comprising:

(a) a pair of spaced form walls for receiving unset concrete therebetween;

(b) a flexible, resilient annular mold having opposite end surfaces, an outer surface and an inner cylindrical surface, said annular mold extending between said form walls and having a length such that its end surfaces are in respectively-sealing contact with the inner surfaces of said form walls, said outer surface having a continuous annular groove intermediate said end surfaces of a depth and shape to receive and fit the pipe-engaging portion of said gasket while the outer anchoring portion of said gasket protrudes outwardly from said outer surface and is exposed in the space between said form walls;

(c) a rigid cylindrical mold-supporting member removably inserted within said annular mold having a length coextensive with that of said annular mold and having an outer surface in contact with the inner surface of said annular mold to support the latter while concrete is cast about the annular mold, about said outer anchoring portion and between said form walls; and (d) means for removably securing mold-supporting member to at least one of said form walls, whereby once the concrete is cured and the form walls removed, said mold-supporting member can be axially withdrawn from said annular mold and the latter withdrawn from the opening and from the gasket by inwardly flexing said annular mold, while the anchoring portion of said gasket remains anchored in the cured concrete.

2. A mold assembly as claimed in claim 1, wherein said form walls are curved, said annular mold having an undercut recess made in one end surface adjacent said inner surface, said mold-supporting member having an outwardly-extending flange at one end fitting into said undercut recess, the thickness of said flange not greater then the depth of said undercut recess, said flanged end and the non-flanged end of said mold-supporting member lying in curved planes to substantially conform to the contour of said form walls, said securing means securing said mold-supporting member against the inside surface of one of said form walls with said flanged end remote from said one form wall and serving also to pull said mold-supporting member towards said one form wall, said flange pressing and flexing said mold against said inside surface to cause the recessed end thereof to conform to and make sealing contact with said inside surface of said one form wall, the flange allowing the recessed end surface of said mold to conform to and make sealing contact with the inside surface of the other one of said form walls.

3. The assembly of claim 1 or 2, wherein both said gasket and said flexible mold are made of rubber.

4. The assembly of claim 2, wherein said means for securing said mold-supporting member to said one form wall include threaded elements secured to the inside surface of the mold-supporting member and bolts passing through said one form wall and engaging said threaded elements.

5. A mold assembly as claimed in claim 2 or 4 wherein said form walls include an outside and an inside form wall, and said one form wall is the outside form wall.

* * * * *